US008875891B2

(12) United States Patent
Yamashita et al.

(10) Patent No.: US 8,875,891 B2
(45) Date of Patent: Nov. 4, 2014

(54) PRESS-THROUGH PACKAGE AND METHOD OF REMOVING MEDICATION FROM SAME

(75) Inventors: Kenji Yamashita, Hyogo (JP); Akiyoshi Yasusato, Hyogo (JP); Tetsuya Yamashita, Hyogo (JP); Kenji Hamada, Hyogo (JP); Goro Kuratani, Hyogo (JP); Masakazu Sugino, Hyogo (JP); Yuko Hanazono, Hyogo (JP); Yoshihiko Matsuoka, Hyogo (JP)

(73) Assignees: Yamashita Works, Co., Ltd. (JP); Titan Co., Ltd. (JP)

( * ) Notice: Subject to any disclaimer, the term of this patent is extended or adjusted under 35 U.S.C. 154(b) by 0 days.

(21) Appl. No.: 13/108,685

(22) Filed: May 16, 2011

(65) Prior Publication Data

US 2011/0214277 A1 Sep. 8, 2011

Related U.S. Application Data

(63) Continuation of application No. PCT/JP2010/061961, filed on Jul. 15, 2010.

(30) Foreign Application Priority Data

Jul. 21, 2009 (JP) ..... 2009-170428
Oct. 14, 2009 (JP) ..... 2009-237231

(51) Int. Cl.
*B65D 83/04* (2006.01)
*A61J 1/03* (2006.01)
*B65D 75/32* (2006.01)

(52) U.S. Cl.
CPC ..... *A61J 1/035* (2013.01); *B65D 83/0445* (2013.01); *B65D 75/327* (2013.01)
USPC ..... 206/531; 206/532; 206/528

(58) Field of Classification Search
CPC ..... B65D 75/327
USPC ..... 206/390, 528, 531, 532, 534.1, 534.2, 206/749, 750, 538, 539, 533, 461, 778, 206/746; 221/25, 305, 31, 70
See application file for complete search history.

(56) References Cited

U.S. PATENT DOCUMENTS 3,605,374 A * 9/1971 Mueller et al. ..... 53/399
3,780,856 A * 12/1973 Braverman ..... 206/534

(Continued)

FOREIGN PATENT DOCUMENTS

DE 3832049 A1 * 3/1990 ..... B65D 75/36
EP 1057744 A2 12/2000

(Continued)

OTHER PUBLICATIONS

International Search Report; PCT/JP2010/061961; Jul. 29, 2010; 2 pages.

*Primary Examiner* — David Fidei
(74) *Attorney, Agent, or Firm* — St. Onge Steward Johnston & Reens LLC

(57) ABSTRACT

A press-through package for articles such as medicines which can reliably prevent a recipient from accidentally swallowing the whole package without opening it, including solid medicines M stored in a plurality of pockets of a base sheet one by one and the pockets sealed by a cover film having attached to the rear surface of the base sheet, wherein the entire package of the press-through package is made in a cylindrical form which cannot allow a recipient from accidentally swallowing and from which the medicines can be taken out easily.

6 Claims, 17 Drawing Sheets

(56) References Cited

U.S. PATENT DOCUMENTS

| | | | | |
|---|---|---|---|---|
| 4,318,477 | A * | 3/1982 | Kerpe | 206/534 |
| 4,799,590 | A * | 1/1989 | Furman | 206/390 |
| 7,211,311 | B2 * | 5/2007 | McDonald | 428/126 |
| 7,261,206 | B2 * | 8/2007 | Rulifson | 206/538 |
| 7,959,004 | B2 * | 6/2011 | Tsao | 206/531 |
| 2004/0173497 | A1 | 9/2004 | Kancsar et al. | |
| 2007/0184078 | A1 * | 8/2007 | Chen | 424/400 |
| 2011/0168732 | A1 * | 7/2011 | Antunes et al. | 221/1 |

FOREIGN PATENT DOCUMENTS

| | | | | |
|---|---|---|---|---|
| GB | 225643 | | 12/1924 | |
| JP | 1990069877 | U | 5/1990 | |
| JP | 2000025855 | A | 1/2000 | |
| JP | 2003501321 | T | 1/2003 | |
| JP | 2003237836 | A | 8/2003 | |
| JP | 2003321075 | A | 11/2003 | |
| WO | WO 9425364 | A1 * | 11/1994 | B65D 75/34 |
| WO | 2004041675 | A1 | 5/2004 | |

* cited by examiner

FIG. 19
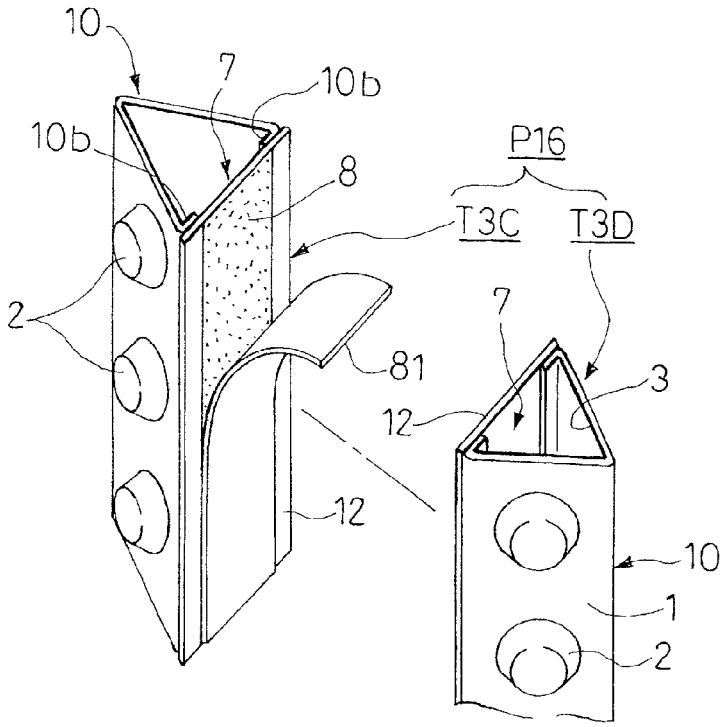
FIG. 20A
FIG. 20B
FIG. 20C
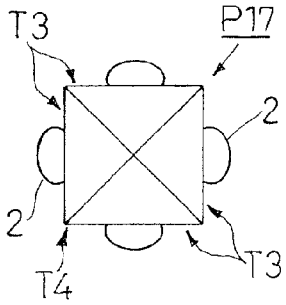
FIG. 20D
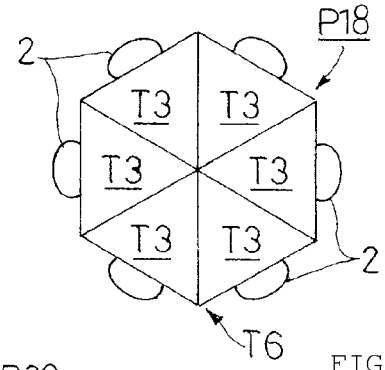
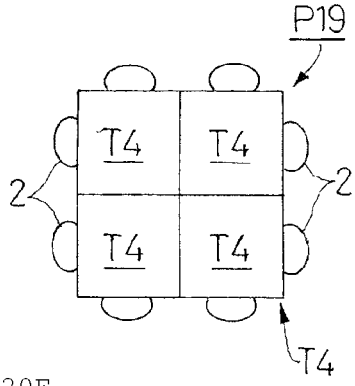
FIG. 20E
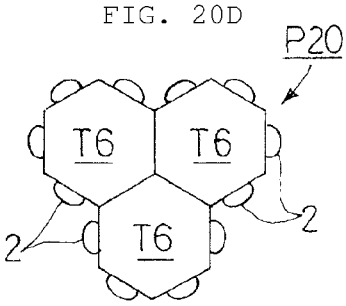
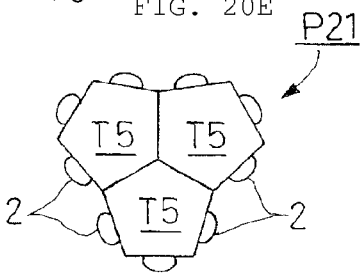

PRESS-THROUGH PACKAGE AND METHOD OF REMOVING MEDICATION FROM SAME

CROSS-REFERENCE TO RELATED APPLICATIONS

The present application is a continuation of pending International patent application PCT/JP2010/061961 filed on Jul. 15, 2010 which designates the United States and claims priority from Japanese patent applications 2009-170428 filed on Jul. 21, 2009 and 2009-237231 filed Oct. 14, 2009, the content of which is incorporated herein by reference.

FIELD OF THE INVENTION

The present invention relates to a press-through package for articles such as medicines wherein a variety of articles such as solid medicines are stored in pockets of a sheet one by one and a method for removing the medicines from the package.

BACKGROUND OF THE INVENTION

Generally, the press-through package (hereinafter, abbreviated as a PTP) for articles such as medicines stores a variety of articles including solid medicines such as pills, tablets, and capsules and solid confectioneries one by one in a plurality of pockets provided on a base sheet made of thermoplastic resin such as polyvinyl chloride, polypropylene, and polyethylene terephthalate. The PTP is then sealed by attaching a cover film of aluminum foil, etc., to the rear surface of the base sheet. The pocket swelling on the front surface is pressed by a fingertip, whereby the article such as solid medicine within the pocket breaks through the cover film and is discharged.

This kind of medicine PTP is used to allow separation into one pocket units (one dosage unit of medicine) by being broken off by hand at vertical and horizontal parting lines provided on the base sheet. However, such accidents that the separated PTP is taken whole without being opened and then the digestive tract such as the esophagus is damaged by an edge of the base sheet and bleeding or serious complications are caused by scratching often occur. Consequently, recent medicine PTP is in a form which can be separated into two or three pocket units only at horizontal parting lines so as not to be easily swallowed accidentally in terms of dimensions. However, even when the unit of separation of the medicine PTP becomes as large as above, particularly the elderly sometimes take the whole PTP. Further, there are quite a number of cases where the PTP having been separated in order to dispense the medicines into a single dose is cut off into a one pocket unit by scissors, etc., and inadvertently swallowed.

On the other hand, this kind of PTP for articles such as medicines has an advantage that small articles can be stored in pockets and completely sealed from the outside as well as being easily opened and taken out. The conventional general-purpose PTP has a sheet configuration as a whole, and thus, when opened, both ends of the sheet are picked up and held by both hands, in which state the pocket is pressed with a thumb or thumbs. Therefore, the article having broken through the cover film and popped out often scatters, falls on the floor or the ground, gets dirty and is no longer good or gets lost and requires time and effort to find. Further, a tear or peeling of the cover film is easily caused while the PTP is carried about in a clothes pocket or a bag, etc. The article often changes in quality due to the seal breaking or comes out of the sheet pocket and is crushed.

On the other hand, a general medicine PTP is inconvenient in terms of handleability because, when the pocket is pressed with a fingertip to take out a medicine, the medicine having broken through the cover film and popped out often scatters, falls on the floor, etc., gets dirty and is no longer good or gets lost and requires time and effort to find.

Accordingly, a variety of means to prevent accidental swallowing and improve handleability in the PTP for articles such as medicines have been proposed up to this point. For example, Patent Document 1 proposes a PTP configuration such that a tear string or strip body which passes portions opposed to the pockets is provided on a cover film every several pocket units divided by cut-off lines of the PTP and that the string or strip body is pulled to break the cover film and open the pockets. Patent Documents 2 and 3 propose a PTP without cut-off lines which is kept in a case composed of a blank board, wherein a pocket of the PTP is pressed with a finger while a top or bottom cover of the case is opened, whereby a medicine is taken out of an ejection portion or hole provided on the case side.

PRIOR ART DOCUMENTS

Patent Documents

Patent Document 1: Japanese Published Unexamined Patent Application No. 2000-25855

Patent Document 2: Japanese Published Unexamined Patent Application No. 2003-237836

Patent Document 3: Japanese Published Unexamined Patent Application No. 2003-321075

SUMMARY OF THE INVENTION

Problems to be Solved by the Invention

However, the afore-proposed PTPs for articles obtain an improvement in the prevention against accidental swallowing but are not effective in preventing the scattering of articles (medicines) due to popping out at the time of opening. Further, the PTPs have drawbacks resulting from respective structures. In the afore-described medicine PTP provided with the tear string or strip body, for example, recipients (patients) need to be more aware of the method of opening of pulling the string or strip body. However, it is difficult to make the method of opening known to such recipients that have a risk of swallowing the whole PTP even when separated into two or three pocket units. Additionally, there is a problem that a reliable prevention against accidental swallowing cannot be achieved since the PTP itself can be divided into two pocket units or more by the cut-off lines. Further, in the configuration of housing the PTP in the holder like a case composed of the blank board, the prevention against accidental swallowing can be reliably realized, but material costs as PTP products significantly increase with attachment of the holder. Additionally, it disadvantageously takes a lot of time and effort to assemble the holder having housed the PTP. Furthermore, to make the recipients more aware of the opening procedure is not easy, and the configuration is not effective in preventing the scattering of medicine at the time of opening.

The present invention was made in view of the afore-described circumstances, and accordingly, an object thereof is to provide a means in a medicine PTP that can reliably prevent a recipient from accidentally swallowing the whole PTP, enables the PTP to be opened without difficulty, does not easily scatter a medicine, requires no additional accessories such as a holder which houses the PTP, and can reduce manufacturing costs.

Another object of the present invention is to provide a PTP for articles wherein an opening operation can be conducted simply by one hand, an article is not easily scattered at the time of opening the PTP, the cover film is not torn or peeled off even when the PTP is carried about in a clothes pocket or a bag, etc., for a long time and a completely sealed state can be maintained, accidentally swallowing the whole PTP can be reliably prevented, and the manufacturing is easy.

Means for Solving the Problems

Means for achieving the above objects are described with reference symbols of the accompanying drawings. A medicine PTP according to the first aspect of the present invention includes a base sheet 1, a plurality of pockets 2 swelling on a front surface of the base sheet 1 and storing solid medicines M one by one, and a cover film 3 attached to a rear surface of the base sheet 1 and sealing the pockets 2, wherewith the medicine PTP in a flat form F is formed, and the medicine PTP further includes a means (an engaging protrusion 51, a slit hole 52, fold back portions 53*a* and 53*b*, an adhesive layer 6, a staple 7, and extending ends 8*a* and 8*b* of a twist tie 8) to fasten both side edges 1*a* and 1*b* of the base sheet 1, wherein the entire medicine PTP in the flat form F is bent and both side edges 1*a* and 1*b* of the base sheet 1 are fastened by the fastening means, whereby the medicine PTP can be maintained in a cylindrical form with the pockets 2 swelling outside.

The second aspect of the present invention is configured in the medicine PTP as set forth in the first aspect such that the base sheet 1 is formed with a plurality of parallel fold lines 4, the medicine PTP in the flat form F is folded at the fold lines 4, and both side edges 1*a* and 1*b* of the base sheet 1 are fastened by the fastening means, whereby the medicine PTP can be maintained in an angular cylindrical form having three to six angles.

The third aspect of the present invention is configured in the medicine PTP as set forth in the first aspect such that the entire medicine PTP in the flat form F is curved and both side edges 1*a* and 1*b* of the base sheet 1 are fastened by the fastening means, whereby the medicine PTP can be maintained in a circular cylindrical form.

A medicine PTP according to the fourth aspect of the present invention includes a base sheet 1, a plurality of pockets 2 swelling on a front surface of the base sheet 1 and storing solid medicines M one by one, and a cover film 3 attached to a rear surface of the base sheet 1 and sealing the pockets 2, wherein both side edges 1*a* and 1*b* of the base sheet 1 are fastened and thus the entire medicine PTP is formed into a cylindrical form with the pockets 2 swelling outside.

The fifth aspect of the present invention is configured in the medicine PTP as set forth in the fourth aspect such that both side edges 1*a* and 1*b* of the base sheet 1 are fastened by a heat seal 9.

A method for removing a medicine from a medicine PTP according to the sixth aspect of the present invention comprises the steps of bending the medicine PTP P1 to P7 in the flat form F as set forth in the first aspect into a cylindrical form T0, T3, or T4 with the pockets 2 swelling outside, joining both side edges 1*a* and 1*b* of the base sheet 1 in the cylindrical form, fastening both side edges 1*a* and 1*b* by the fastening means, and pressing a necessary pocket 2 from the outside to break through the cover film 3 and discharge a solid medicine M within the pocket 2 inside the PTP in the cylindrical form T0, T3, or T4.

A method for removing a medicine from a medicine PTP according to the seventh aspect of the present invention comprises the steps of using the medicine PTP P8 or P9 in the cylindrical form T0 or T4 as set forth in the fourth aspect, and pressing a necessary pocket 2 in the medicine PTP P8 or P9 from the outside to break through the cover film 3 and discharge a solid medicine M within the pocket 2 inside the PTP in the cylindrical form T0 or T4.

A PTP according to the eighth aspect of the present invention includes a base sheet 1, a plurality of pockets 2 swelling on a front surface of the base sheet 1 and storing articles (solid medicines or solid health food M1 to M5, candies M6, chocolate chips M7, frosted sugar M8, small screws M9, nuts M10, and washers M11) respectively, a cover film 3 attached to a rear surface of the base sheet 1 and sealing the pockets 2, a PTP sheet 10 constituted by the base sheet 1, the plurality of pockets 2, and the cover film 3, and a cylindrical body (a triangular cylindrical body T3, a square cylindrical body T4, a pentagonal cylindrical body T5, a hexagonal cylindrical body T6, and a circular cylindrical body T0) with the pockets 2 swelling on an outer periphery thereof, the cylindrical body formed by bending the PTP sheet 10, wherein a necessary pocket 2 in the cylindrical body is pressed from the outside, and an article having broken through the cover film 3 and discharged inside the cylindrical body is taken out of an opening (a cylinder opening 11) at one end of the cylindrical body.

The ninth aspect of the present invention is configured in the PTP as set forth in the eighth aspect such that the PTP sheet 10 is formed into the cylindrical body by fastening both side edges 10*a* and 10*b* thereof.

The tenth aspect of the present invention is configured in the PTP as set forth in the eighth aspect such that the PTP sheet 10 having been bent into a cylindrical shape has a cylinder opening 11 to which an annular opening frame member 4 is fitted and fixed.

The eleventh aspect of the present invention is configured in the PTP as set forth in the eighth aspect by further including a strip edge frame 5 with a pair of grooves 5*a* along both side edges thereof, wherein the cylindrical body is formed by inserting and fixing both side edges 10*a* of the PTP sheet 10 to the grooves 5*a* of the strip edge frame 5 respectively.

The twelfth aspect of the present invention is configured in the PTP as set forth in the eighth aspect such that the cylindrical body is formed into a polygonal cylinder having four or more angles and has an interior provided with a reinforcing plate 6 arranged along a diagonal direction and having both lateral portions 6*a* fastened to an inner surface of the cylindrical body.

The thirteenth aspect of the present invention is configured in the PTP as set forth in the eighth aspect such that the cylindrical body is formed into a triangular to hexagonal cylinder having at least one side surface formed into a flat surface 12 without the pockets 2, and a plurality of the angular cylinders are integrated by joining the flat surfaces 12 to each other.

The fourteenth aspect of the present invention is configured in the PTP as set forth in the thirteenth aspect such that the flat surface 12 is formed by another plate body 7 aside from the PTP sheet 10, and the plate body 7 has both lateral portions to which both side edges 10*b* of the PTP sheet 10 are fastened.

The fifteenth aspect of the present invention is configured in the PTP as set forth in the eighth aspect such that the pockets 2 are arranged in a plurality of columns along a longitudinal direction of the cylindrical body or in a plurality of rows along a circumferential direction of the cylindrical body, and different kinds of articles according to the columns or the rows are stored in the pockets.

The sixteenth aspect of the present invention is configured in the PTP as set forth in the eighth aspect such that the articles are solid medicines M1 to M6 or solid food (solid confectioneries M7 to M8).

Effects of the Invention

Subsequently, effects of the present invention will be described with the reference symbols of the accompanying drawings. First, the medicine PTP P1 to P7 according to the first aspect of the present invention cannot be separated into one pocket unit or two or three pocket units. Additionally, the medicine PTP P1 to P7 assumes the cylindrical form T0, T3, or T4 as a whole at the time of taking a medicine. Therefore, there is no other choice but to press each pocket 2 with a finger and break the seal in order to take out medicines M. There is no possibility that the recipient swallows the whole PTP without opening it. When the recipient presses each pocket 2 with a finger and breaks the seal, the medicine M having broken through the cover film 3 is discharged inside the PTP in the angular cylindrical form T0, T3, or T4 and cannot pop out improperly or be scattered around. Thus, the medicine M is received by a wide-mouthed shallow container R, etc., for example, thereby being able to be prevented from falling on the floor, etc., and getting dirty or lost. Further, the medicine PTP P1 to P7 can be bent into the cylindrical form T0, T3, or T4 by itself and requires no additional accessories such as a holder for housing the medicine PTP. Thus, an increase in cost due to the accessories can be avoided.

According to the second aspect of the present invention, the medicine PTP in the flat form F is folded at the fold lines 4 of the base sheet 1 and both side edges 1*a* and 1*b* of the base sheet 1 are fastened to each other, thereby being able to be assembled into the angular cylindrical form T3 or T4 having three to six angles easily.

According to the third aspect of the present invention, the entire medicine PTP in the flat form F is curved and both side edges 1*a* and 1*b* of the base sheet 1 are fastened, thereby being able to be assembled into the circular cylindrical form T0 easily.

In the medicine PTP according to the fourth aspect of the present invention, both side edges 1*a* and 1*b* of the base sheet 1 are fastened and the medicine PTP is made into the cylindrical form T0 or T4 in advance. Thus, a necessary pocket 2 in the medicine PTP in the cylindrical form T0 or T4 has only to be opened at the time of taking the medicine M, and effort to assemble the medicine PTP into the angular cylindrical form T0 or T4 at the pharmacy is eliminated.

According to the fifth aspect of the present invention, both side edges 1*a* and 1*b* of the base sheet 1 configured to be made into the cylindrical form T0 or T4 in advance are fastened by a heat seal 9. Thus, the assembling into the cylindrical form T0 or T4 can be done very efficiently and easily in a short time.

In the method for removing a medicine from a medicine PTP according to the sixth aspect of the present invention, the medicine PTP P1 to P7 is bent from the flat form F to the cylindrical form T0, T3, or T4 and then joined both side edges 1*a* and 1*b* of the base sheet 1 are fastened at the pharmacy, whereafter the medicine PTP may be handed to the recipient (patient). By this, the recipient can simply take out the solid medicine M from the received medicine PTP P1 to P7 in the cylindrical form T0, T3, or T4 only by pressing a necessary pocket 2 with a finger from the outside. The operation is significantly simplified and there is no concern for swallowing the medicine PTP without opening it. Further, there is no need to acquire individual opening methods.

In the method for removing a medicine from a medicine PTP according to the seventh aspect of the present invention, the medicine PTP P8 or P9 is made into the cylindrical form T0 or T4 in advance. Thus, the recipient (patient) can simply take out a solid medicine M only by pressing a necessary pocket 2 with a finger from the outside. The operation is significantly simplified and there is no concern for swallowing the medicine PTP without opening it. Further, there is no need to acquire individual opening methods.

In the PTP according to the eighth aspect of the present invention, the PTP sheet 10 forms a cylindrical body (a triangular cylindrical body T3, a square cylindrical body T4, a pentagonal cylindrical body T5, a hexagonal cylindrical body T6, and a circular cylindrical body T0) with the pockets 2 swelling on the outer periphery thereof. The cylindrical body is grasped by one hand H and a necessary pocket 2 is pressed with a thumb F1 of the hand H from the outside, whereby an article (a solid medicine or solid health food M1 to M5, a candy M6, a chocolate chip M7, frosted sugar M8, a small screw M9, a nut M10, or a washer M11) having been stored in the pocket 2 breaks through the cover film 3 and is discharged inside the cylindrical body. Therefore, there is no concern that the article having popped out from the pocket is scattered around as in the conventional PTP. Additionally, the opening operation can be conducted by one hand H, so that the article to be dropped and discharged from the downward opening (cylinder opening 11) of the cylindrical body can be reliably received by the palm of a disengaged hand. Such conventional problems that the medicine falls on the floor or the ground, gets dirty and is no longer good or gets lost and requires effort to find do not arise. Further, the entire cover film 3 of the PTP sheet 10 is located at the inner periphery of the cylindrical body. Thus, the cover film 3 does not come into contact with fabric or another article even when the PTP is carried about in a clothes pocket or a bag, etc., for a long time. A tear or peel of the cover film 3 due to contact is not caused and a completely sealed state can be maintained.

Furthermore, the entire PTP sheet 10 constitutes the cylindrical body in this PTP, which cannot be separated into one pocket unit or two or three pocket units. Additionally, there is no other choice but to press each pocket 2 with a finger and break the seal in order to take out the articles. Accordingly, there is no possibility particularly in the instance of the PTP P10 to P23 for medicines or food that the user swallows the whole PTP without opening it.

According to the ninth aspect of the present invention, the cylindrical body T3 to T6, or T0 can be formed by fastening both side edges 10*a* and 10*b* of the PTP sheet 10. Therefore, no additional accessories such as a holder for housing the PTP sheet 10 are required, whereupon an increase in cost due to the accessories can be avoided.

According to the tenth aspect of the present invention, the annular opening frame member 4 is fitted and fixed to the cylinder opening 11 of the PTP sheet 10 having been bent into the cylindrical shape. Thus, shape retaining strength as the cylindrical body is enhanced, whereupon there is no concern that the cylindrical shape gets crushed at the time of opening even if the material of the PTP sheet 10 is non-elastic, and the opening operation can be conducted easily.

According to the eleventh aspect of the present invention, the cylindrical body can be formed by inserting and fixing both side edges 10*a* of the PTP sheet 10 to both grooves 5*a* of the strip edge frame 5. Thus, shape retaining strength as the cylindrical body is enhanced and the assembling and manufacturing thereof is facilitated.

According to the twelfth aspect of the present invention, the reinforcing plate 6 is arranged along the diagonal direction inside the cylindrical body configured to be a polygonal cylinder having four or more angles. Thus, shape retaining strength as the cylindrical body is enhanced and the opening operation can easily and reliably be conducted accordingly.

According to the thirteenth aspect of the present invention, a plurality of triangular to hexagonal cylindrical bodies T3 to T6 each having at least one side formed into a flat surface 12 without the pockets 2 are integrated by joining the flat surfaces 12 to each other. Thus, the cylindrical bodies T3 to T6 having been formed by using the PTP sheets 10 storing different articles respectively are joined to each other to be integrated, whereby a single PTP P6 to P12 storing a plurality of kinds of articles can be provided easily.

According to the fourteenth aspect of the present invention, the flat surface 12 of each cylindrical body is formed by another plate body 7 aside from the PTP sheet 10 in the above PTP in which a plurality of the cylindrical bodies T3 to T6 are joined to be integrated. Thus, an appropriate joining means can be selected regardless of the material of the PTP sheet 10, and shape retaining strength as the joined and integrated PTP can be increased by using the plate body 7 with a large rigidity.

According to the fifteenth aspect of the present invention, the pockets 2 arranged in a plurality of columns along the longitudinal direction of the cylindrical body or in a plurality of rows along the circumferential direction store different kinds of articles according to the columns or the rows. Thus, a plurality of types of medicines to be taken in a single dose or a plurality of kinds of other articles to be used in a set can be arranged around the cylindrical body, for example.

According to the sixteenth aspect of the present invention, the PTP which can reliably prevent the user from swallowing the whole PTP without opening it in the case where the articles are solid medicines M1 to M5 or solid food (candies M6, chocolate chips M7, or frosted sugar M8) is provided.

BRIEF DESCRIPTION OF THE DRAWINGS

FIG. 1A is a perspective view of the PTP in a flat form and FIG. 1B is a cross sectional view of the PTP in an angular cylindrical form;

FIG. 2A is a perspective view of the PTP in a flat form and FIG. 2B is a cross sectional view of the PTP in an angular cylindrical form;

FIG. 3A is a perspective view of the PTP in a flat form and FIG. 3B is a cross sectional view of the PTP in a square cylindrical form;

FIG. 4A is a perspective view of the PTP in a flat form and FIG. 4B is a cross sectional view of the PTP in a square cylindrical form;

FIG. 5A is a perspective view of the PTP in a flat form and FIG. 5B is a cross sectional view of the PTP in a triangular cylindrical form;

FIG. 6A is a perspective view of the PTP in a flat form and FIG. 6B is a perspective view of the PTP in a triangular cylindrical form;

FIG. 7A is a perspective view of the PTP in a flat form and FIG. 7B is a cross sectional view of the PTP in a circular cylindrical form;

FIG. 15A is a perspective view of a main part before an opening frame member is fitted and FIG. 15B is a perspective view of the main part after the opening frame member is fitted;

FIG. 17A is a cross sectional plan view of a PTP according to the thirteenth embodiment and FIG. 17B is a cross sectional plan view of a PTP according to the fourteenth embodiment;

FIG. 18A is a perspective view of a main part of cylindrical bodies before being joined and FIG. 18B is a cross sectional plan view of the cylindrical bodies after being joined;

FIG. 19 is a perspective view of a main part of cylindrical bodies before being joined in a PTP of a sixteenth embodiment of the present invention;

FIGS. 20A-20E show seventeenth to twenty-first embodiments of the present invention, and FIG. 20A is a schematic plan view of a PTP of the seventeenth embodiment, FIG. 20B is that of the eighteenth embodiment, FIG. 20C is that of the nineteenth embodiment, FIG. 20D is that of the twentieth embodiment, and FIG. 20E is that of the twenty-first embodiment, respectively;

FIG. 24A is a perspective view of a main part in a state where PTPs in the square cylindrical form are housed and FIG. 24B is a perspective view of a main part in a state where PTPs in the triangular cylindrical form are housed.

DETAILED DESCRIPTION OF THE INVENTION

Best Modes for Carrying Out the Invention

Figure 1A:
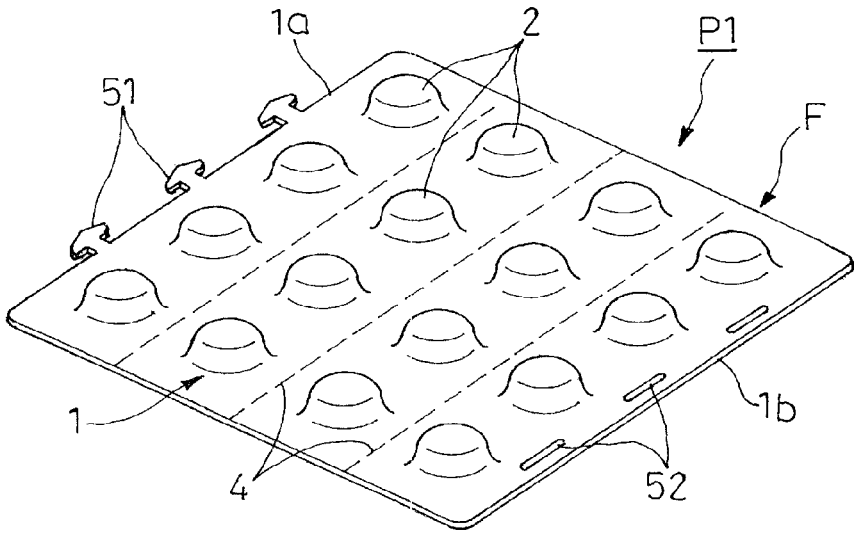
FIGS. 1A-1B show a medicine PTP according to a first embodiment of the present invention.
Figure 1B:
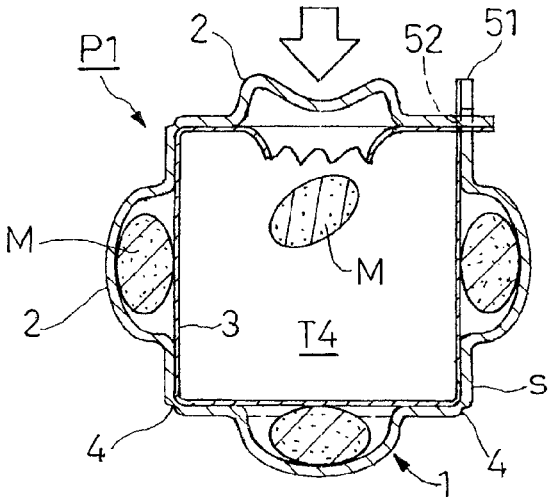

A medicine PTP P1 of the first embodiment as shown in FIGS. 1A-1B includes a rectangular transparent base sheet 1 formed of thermoplastic resin such as polyvinyl chloride, polypropylene, and polyethylene terephthalate and a plurality (16 pieces in FIG. 1A) of pockets 2 swelling roundly on the front surface of the base sheet 1 and arranged in a matrix. Solid medicines M in the form of round sugar-coated pills are stored in respective pockets 2 one by one, and in this state, a cover film 3 formed of aluminum foil is attached to the rear surface of the base sheet 1, whereby respective pockets 2 are sealed. The medicine M within each pocket 2 is configured to break through the cover film 3 and be discharged by pressing the pocket 2 with a fingertip from the front surface on which the pocket 2 swells.

Referring to a bottom-left to top-right direction in FIG. 1A as a longitudinal direction, the base sheet 1 of the medicine PTP P1 is formed with three equidistant parallel fold lines 4 delimiting the group of pockets 2 into every one column. The base sheet 1 has two side edges 1*a* and 1*b*, one of which 1*a* is provided with three pieces of substantially arrow-shaped engaging protrusions 51 which protrude laterally and are spaced at regular intervals. The other side edge 1*b* is provided with three slit holes 52 opposed to the respective engaging protrusions 51 and extending along the longitudinal direction. It is noted that the fold lines 4 are composed of linear thin portions so as to be easily bent but not easily torn. The engaging protrusions 51 and the slit holes 52 are formed at the same time as when the base sheet 1 is stamped from a raw sheet.

The medicine PTP P1 is delivered in a space-saving flat form F as shown in FIG. 1A from a manufacturer such as a drug manufacturer to a dispensary of a medical institution or a pharmacy. The PTP P1 is transformed in advance into a square cylindrical form T4 as shown in FIG. 1B when handed to a patient according to a prescription. More specifically, the PTP P1 in the flat form F is folded 90 degrees at each fold line 4 with convexes facing outside, thereby being bent into a square cylindrical shape as a whole where the pockets 2 swell on the outside of each lateral surface s. Further, each engaging protrusion 51 at the side edge 1*a* of the base sheet 1 is inserted and fitted to each slit hole 52 at the other side edge 1*b*, whereby the PTP P1 is assembled into the square cylindrical form T4 and given to the patient.

Since having no cut-off lines on the base sheet 1 from the start, the medicine PTP P1 in the square cylindrical form T4 cannot be separated into small units such as one or two pockets by hand. Further, to separate the medicine PTP P1 into small units by scissors, etc., is not conceivable from its three-dimensional structure. Thus, the patient has no other choice but to press the pocket 2 with a finger to break the seal in order to remove and take the medicine M, and there is no possibility of swallowing the whole PTP without opening it. Once the patient presses the pocket 2 with a finger to break the seal, the medicine M having broken through the cover film 3 is discharged inside the PTP in the square cylindrical form T4 as shown in FIG. 1B. As a result, the medicine M cannot improperly pop out and be scattered around. Therefore, it is possible to avoid the medicine M from falling on the floor, etc., and getting dirty and becoming no longer good or getting lost and requiring time and effort to find.

Figure 2A:
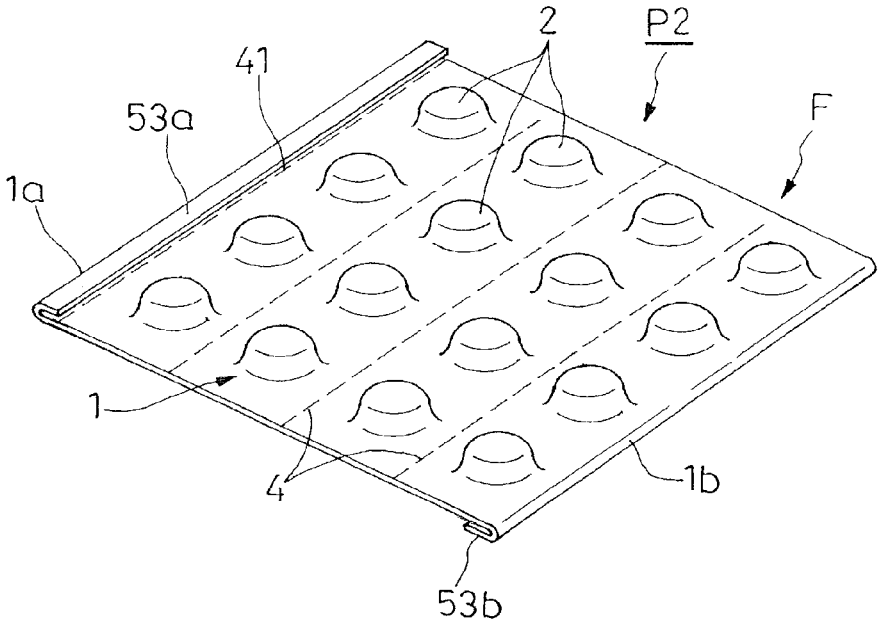
FIGS. 2A-2B show a medicine PTP according to a second embodiment of the present invention.
Figure 2B:
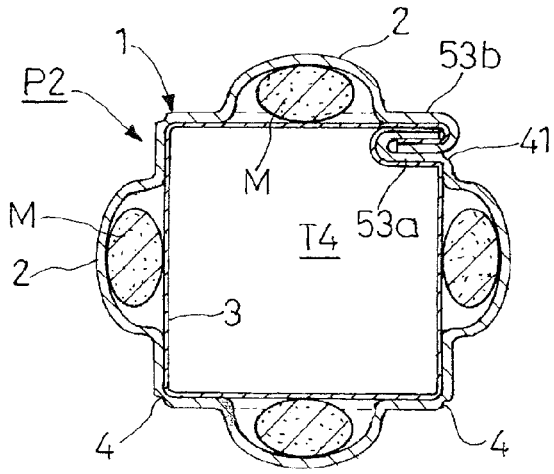

Next, FIGS. 2A-2B are referred to, in which a medicine PTP P2 of the second embodiment is shown. In the medicine PTP P2, a base sheet 1 has three fold lines 4 and solid medicines M are stored in pockets 2 of the base sheet 1 one by one in the same manner as the first embodiment. In this state, a cover film 3 is attached to the rear surface of the base sheet 1 and seals each pocket 2. The base sheet 1 has two side edges 1*a* and 1*b*, one of which 1*a* is formed with an upward fold back portion 53*a* via a fold line 41, and the other of which 1*b* is formed with a downward fold back portion 53*b*. The medicine PTP P2 is bent into a square cylindrical shape from a flat form F when delivered as shown in FIG. 2A in the same manner as the first embodiment. While the fold line 41 is folded inward, the fold back portions 53*a* and 53*b* of both side edges 1*a* and 1*b* of the base sheet 1 are attached to each other. The PTP is handed to the patient in a square cylindrical form T4 as shown in FIG. 2B.

Figure 3A:
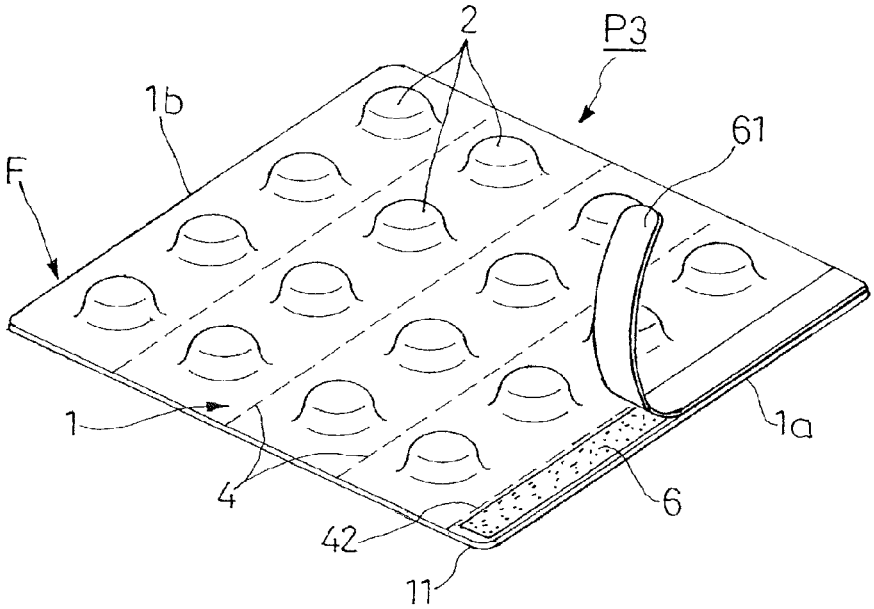
FIGS. 3A-3B show a medicine PTP according to a third embodiment of the present invention.
Figure 3B:
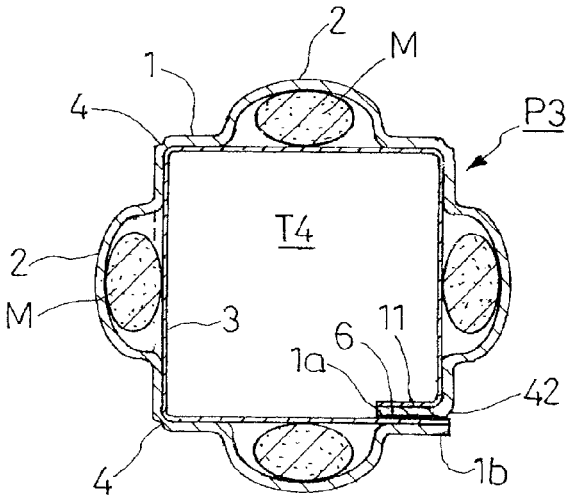

In a medicine PTP P3 of the third embodiment as shown in FIGS. 3A-3B, again, a base sheet 1 has three fold lines 4 and solid medicines M are stored in each pocket 2 of the base sheet 1 one by one. In this state, a cover film 3 is attached to the rear surface of the base sheet 1. The base sheet 1 has one side edge 1*a* provided with a strip adhesive piece 11 demarcated by a fold line 42 across an entire length of the side edge 1*a*. An adhesive layer 6 with a release paper 61 is formed on the front surface of the adhesive piece 11. The medicine PTP P3 is bent at each fold line 4 into a square cylindrical shape from a flat form F when delivered as shown in FIG. 3A in the same manner as above, and the adhesive piece 11 at the side edge 1*a* is folded inward at the fold line 42 as shown in FIG. 3B. The release paper 61 is peeled off to expose the adhesive layer 6, and the exposed adhesive layer 6 is adhered to the rear surface of the side edge 1*b*. Then, the PTP is handed to the patient in a square cylindrical form T4.

Figure 4A:
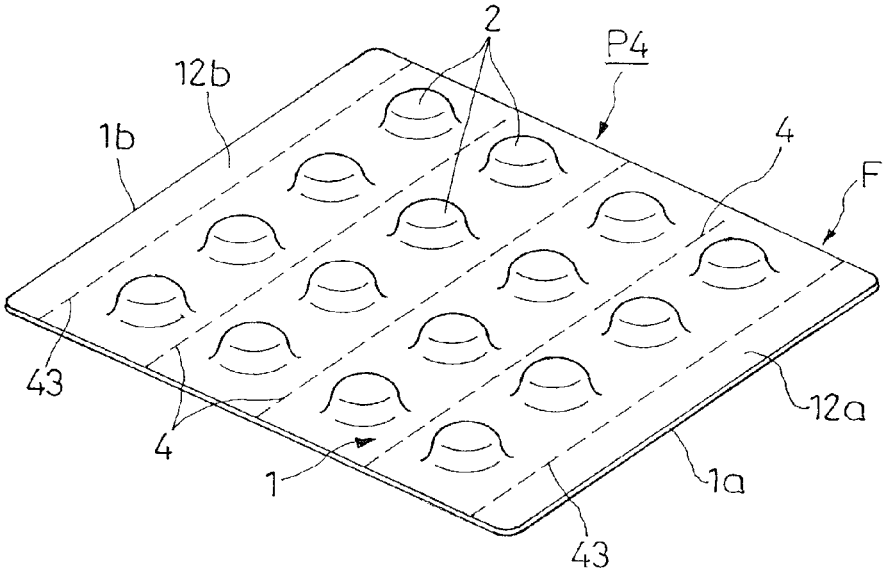
FIGS. 4A-4B show a medicine PTP according to a fourth embodiment of the present invention.
Figure 4B:
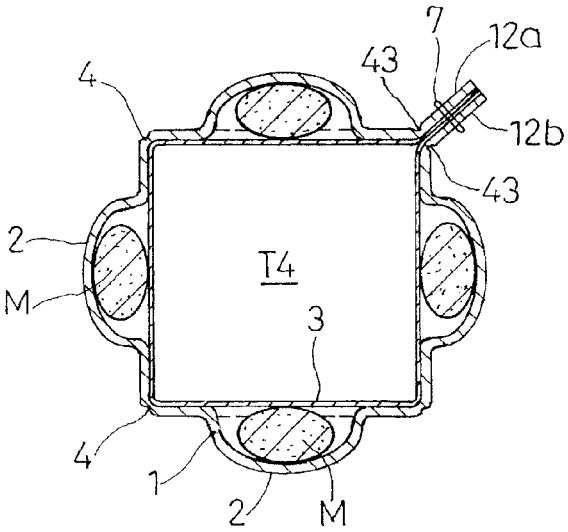

Further, in a medicine PTP P4 of the fourth embodiment as shown in FIGS. 4A-4B, a base sheet 1 has three fold lines 4 and solid medicines M are stored in each pocket 2 of the base sheet 1 one by one in the same manner. In this state, a cover film 3 is attached to the rear surface of the base sheet 1. The base sheet 1 has both side edges 1*a* and 1*b* provided with respective strip fastening pieces 12*a* and 12*b* demarcated by fold lines 43 across the entire lengths of the side edges 1*a* and 1*b*. The medicine PTP P4 is bent at each fold line 4 into a square cylindrical shape from a flat form F when delivered as shown in FIG. 4A in the same manner as above. Both fastening pieces 12*a* and 12*b* having been folded outward into a dogleg shape and joined to each other are fastened by a staple 7 as shown in FIG. 4B. Then, the PTP is handed to the patient in a square cylindrical form T4. However, it is also possible that the back surface of the strip fastening pieces 12*a* and 12*b* at both side edges 1*a* and 1*b* of the base sheet 1 are configured to be free from the cover film 3 and the joined fastening pieces 12*a* and 12*b* are thermally welded to be fastened and integrated, instead of being fastened by the staple 7.

In these medicine PTPs P2 to P4 of the second to fourth embodiments as well, there is no possibility that the patient swallows the whole PTP without opening it, and the medicine M is discharged inside the PTP in the square cylindrical form T4 at the time of opening and thus it is possible to avoid the medicine M from falling on the floor, etc., and getting dirty and becoming no longer good or getting lost and requiring time and effort to find, similar to the medicine PTP P1 of the first embodiment. Furthermore, including the first embodiment, the medicine PTPs P1 to P4 can be bent into the square cylindrical form T4 by themselves and require no additional accessories such as a holder for housing the PTPs. Accordingly, an increase in cost due to the accessories can be avoided.

Although the afore-described medicine PTPs P1 to P4 of the first to fourth embodiments are handed to the patient in the square cylindrical form T4, the medicine PTP of the present invention includes configurations made into a triangular cylindrical form as in the fifth and sixth embodiments as described below, a pentagonal cylindrical form, a hexagonal cylindrical form, or a circular cylindrical form as in the seventh embodiment. However, a polygonal cylindrical form with seven or more angles is too bulky and the cylindrical shape thereof easily gets out of shape and handleability is reduced.

Figure 5A:
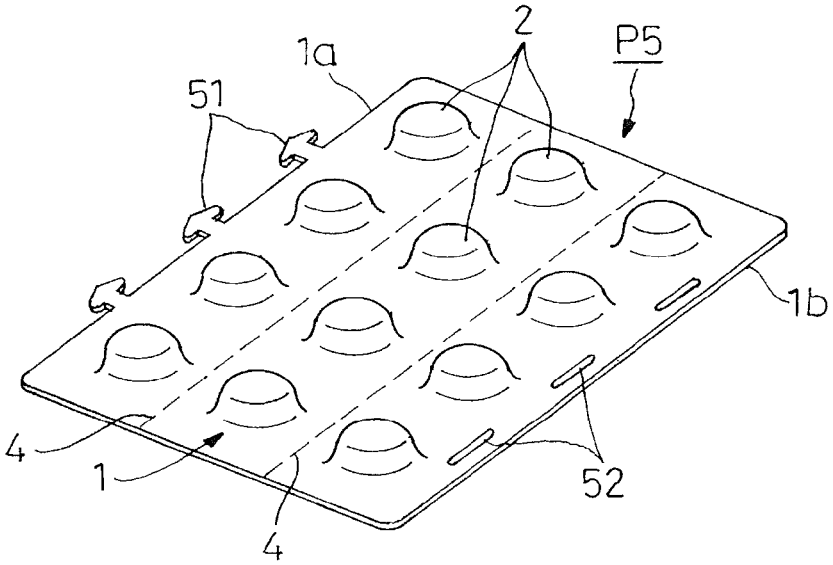
FIGS. 5A-5B show a medicine PTP according to a fifth embodiment of the present invention.
Figure 5B:
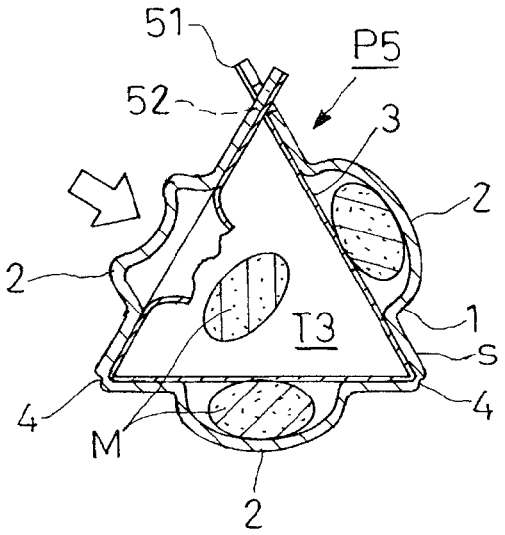

A medicine PTP P5 of the fifth embodiment as shown in FIGS. 5A-5B has the same configuration as the medicine PTP P1 of the first embodiment as described above except for providing a base sheet 2 with two fold lines 4, corresponding to pockets 2 in three columns. The medicine PTP P5 in a flat form F as shown in FIG. 5A is folded 60 degrees at each fold line 4 with convexes facing outside, thereby being bent into a triangular cylindrical shape as a whole where the pockets 2 swell on the outside of each lateral surface s. Further, each engaging protrusion 51 at the side edge 1*a* of the base sheet 1 is inserted and fitted to each slit hole 52 at the other side edge 1*b*, whereby the PTP P1 is given to the patient in a triangular cylindrical form T3 as shown in FIG. 5B.

Figure 6A:
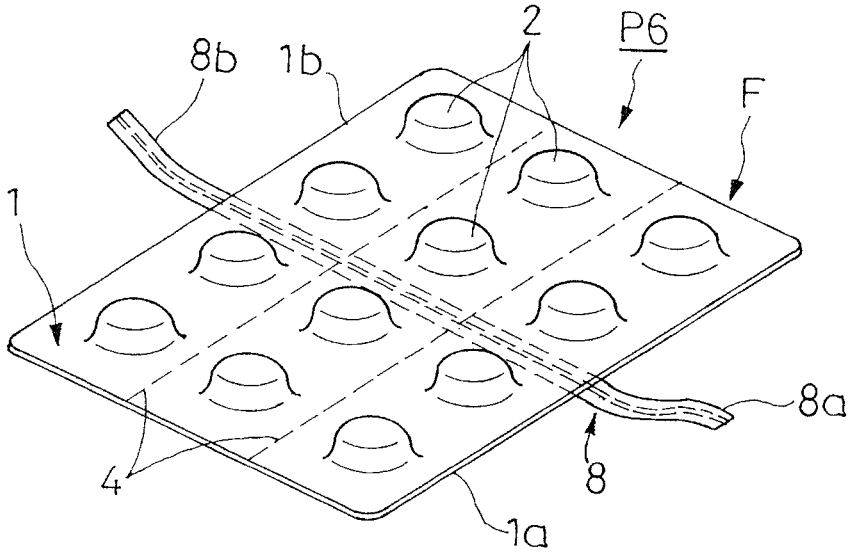
FIGS. 6A-6B show a medicine PTP according to a sixth embodiment of the present invention.
Figure 6B:
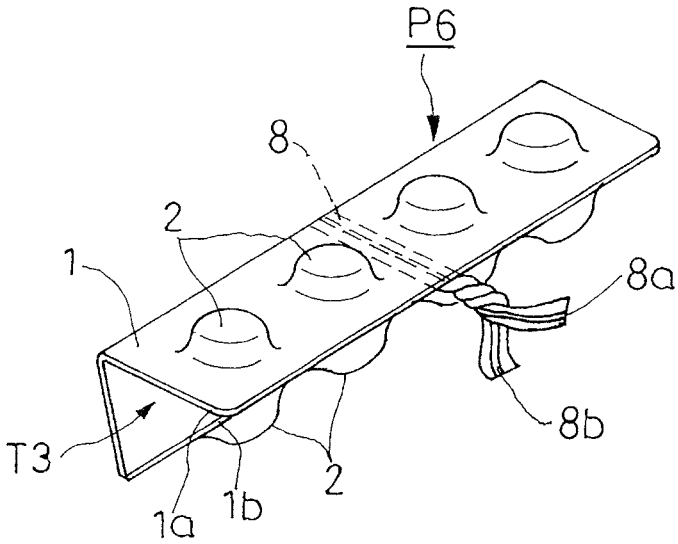

A medicine PTP P6 of the sixth embodiment as shown in FIGS. 6A-6B includes a base sheet 1 provided with pockets 2 in three columns and two fold lines 4. A twist tie 8 is fused on the rear surface of the base sheet 1 along a crosswise direction, and a cover film 3 is attached thereon. The twist tie 8 has both ends 8*a* and 8*b* extending outward from central positions of both side edges 1*a* and 1*b* of the base sheet 1 respectively. The medicine PTP P6 in a flat form F as shown in FIG. 6A is folded 60 degrees at each fold line 4 with convexes facing outside, thereby being bent into a triangular cylindrical shape, in the same manner as the above fifth embodiment. Then, both ends 8*a* and 8*b* of the twist tie 8 are twisted together as in FIG. 6B, whereupon the PTP P6 is given to the patient in a triangular cylindrical form T3.

Figure 7A:
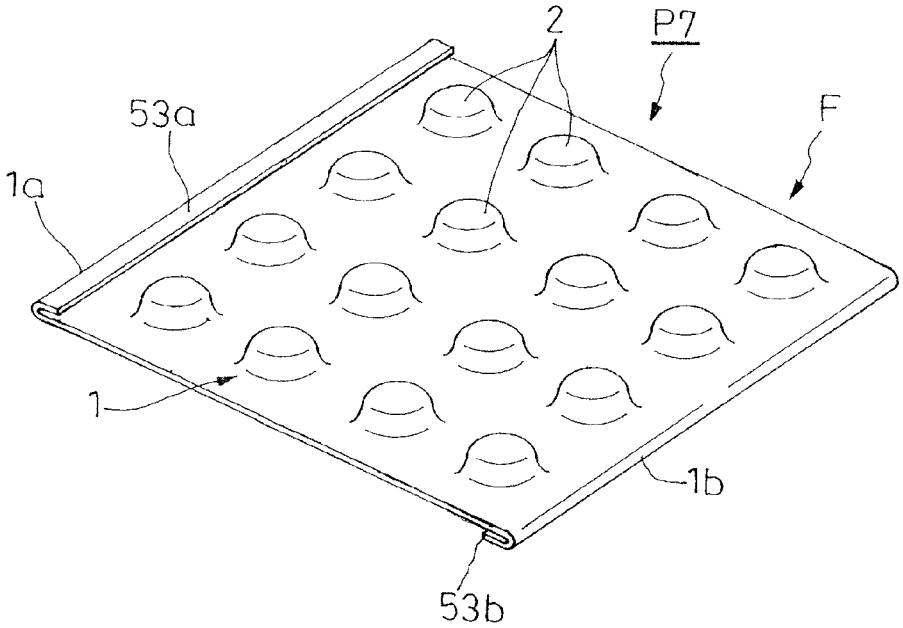
FIGS. 7A-7B show a medicine PTP according to a seventh embodiment of the present invention.
Figure 7B:
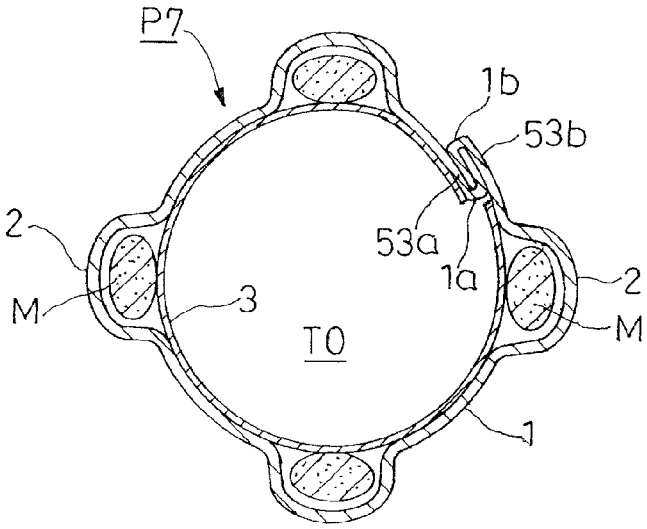

A medicine PTP P7 of the seventh embodiment as shown in FIGS. 7A-7B includes a base sheet 1 provided with each pocket 2 to which solid medicines M are stored one by one. In this state, a cover film 3 is attached to the rear surface of the base sheet 1 and seals each pocket 2. Although provided with no fold lines, the base sheet 1 has two side edges 1*a* and 1*b*, one of which 1*a* is formed with an upward fold back portion 53*a* and the other of which 1*b* is formed with a downward fold back portion 53*b*. The entire PTP is curved into a circular cylindrical shape from a flat form F when delivered as shown in FIG. 7A. The fold back portions 53*a* and 53*b* at both side edges 1*a* and 1*b* are attached to each other, whereupon the PTP P7 is handed to the patient in a circular cylindrical form T0 as shown in FIG. 7B.

In these medicine PTPs P5 and P6 in the triangular cylindrical form T3 as in the fifth and sixth embodiments and medicine PTP P7 in the circular cylindrical form T0 as in the seventh embodiment as well, there is no possibility that the patient swallows the whole PTP without opening it, and a medicine M having broken through the cover film 3 is discharged inside the PTP in the cylindrical form T3 or T0 when a necessary pocket 2 is pressed with a finger and opened. Consequently, reliable prevention against accidental swallowing can be achieved and the scattering of the medicine M at the time of opening can be prevented in the medicine PTPs P5 to P7 as well.

The afore-described medicine PTPs P1 to P7 of the first to seventh embodiments are delivered to a dispensary of a medical institution or a pharmacy, etc., in the flat forms F. However, if the PTPs are assembled into the cylindrical forms at a manufacturer such as a drug manufacturer in advance and then supplied, there is a great advantage that the effort of assembling the PTPs into the cylindrical forms at the dispensary or pharmacy, etc., can be saved although the PTPs are bulky at the time of transportation or storage. On the occasion where the PTPs are made into the cylindrical forms at the manufacturer side as described above, both side edges 1*a* and 1*b* of the base sheet 1 do not need to have individual fastening structures as in the first to seventh embodiments and can be fused directly by a heat seal. Additionally, the process of bending the PTP into the cylindrical form and the process of heat sealing are incorporated after the process of attaching the cover film 3 in a continuous manufacturing line of the medicine PTP and then the processes are automated, whereupon high production efficiency can be achieved.

Figure 8:
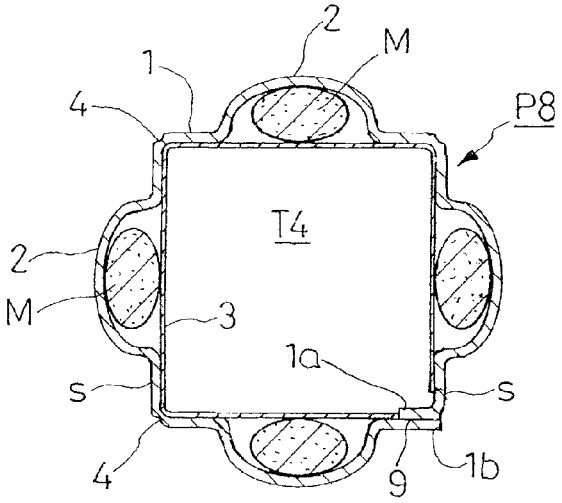
FIG. 8 is a cross sectional view of a medicine PTP in a square cylindrical form according to an eighth embodiment of the present invention.
Figure 9:
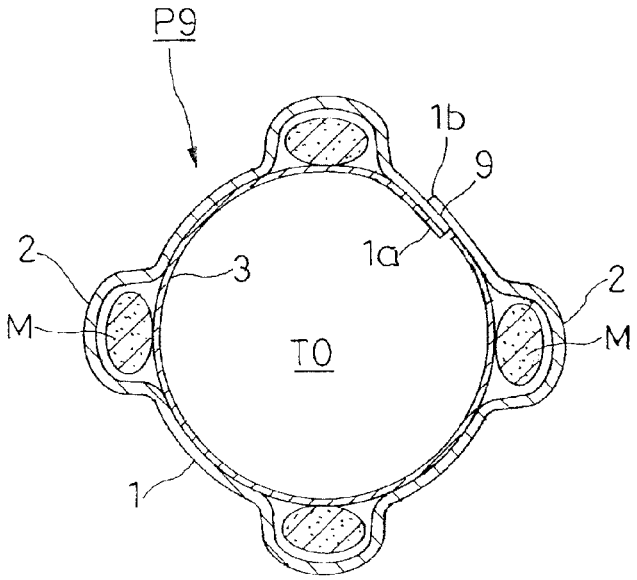
FIG. 9 is a cross sectional view of a medicine PTP in a circular cylindrical form according to a ninth embodiment of the present invention.

Medicine PTPs P8 and P9 of the eighth and ninth embodiments as shown in FIG. 8 and FIG. 9 are made into cylindrical forms as a whole in advance by welding both side edges 1*a* and 1*b* of the base sheet 1 with the use of the heat seal 9, that is, the PTP P8 is into a square cylindrical form and the PTP P9 into a circular cylindrical form. It is a matter of course that the cylindrical form having been made in advance may be a polygonal cylindrical form other than the square cylindrical shape or may be an ellipsoidal cylindrical form.

Figure 10:
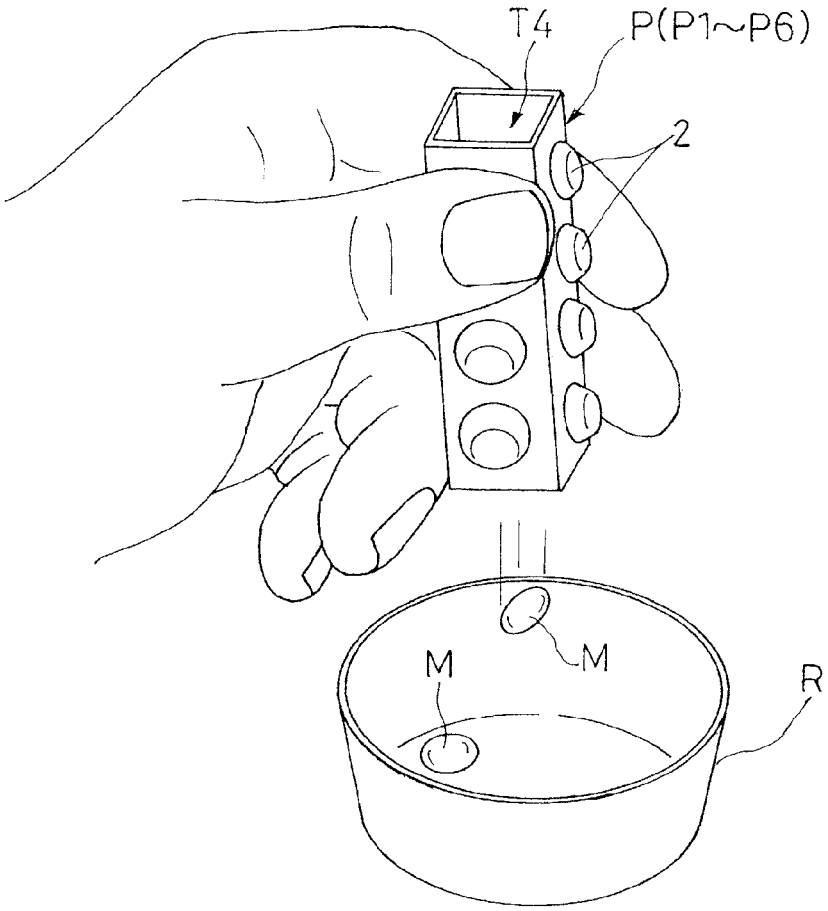
FIG. 10 is a perspective view exemplifying an operation of removing a medicine from the medicine PTP of the present invention.

In the medicine PTP of the present invention, the medicine M is taken out by opening the PTP in the cylindrical form. Thus, it is easy to open the PTP while an opening at one end of the cylindrical form is directed downward and to receive the falling medicine M with a disengaged palm. When the medicine M is configured to be received by a wide-mouthed shallow container R as shown in FIG. 10, for example, the scattering of the medicine M can be prevented more reliably. Furthermore, on the occasion of taking a plurality of types of medicines having been stored in the PTP simultaneously, the medicines can conveniently be received by the same container R sequentially in the same manner and taken all at once.

On the other hand, for medicine PTP products sold over the counter as, for example, medicines for colds, antipyretic analgesics, and troches, etc., the assembling of the PTP from the flat form to the cylindrical form by a recipient himself/herself requires effort and a procedure thereof may be mistaken. There is also concern that the recipient separates the PTP in the flat form F into smaller units such as one pocket by scissors, etc., and inadvertently swallows the PTP without opening it. Accordingly, it is recommended for the medicine PTP products sold over the counter to assemble the PTP from the flat form to the cylindrical form at the manufacturer side in advance as already described, and to fill a packing box B with a plurality of the medicine PTPs P in the square cylindrical form T4 or the triangular cylindrical form T3 as exemplified in FIG. 24A-24B, for example, or further a circular cylindrical form (not shown) to be marketed. On this occasion, the PTP in the triangular cylindrical form T3 preferably has a cylindrical shape of an isosceles right triangle as shown rather than an equilateral triangle in order to facilitate storing a plurality of the PTPs in a rectangular space.

Particularly for the medicine PTP made into the cylindrical form in advance, space efficiency can be increased by arranging the pockets 2 of the base sheet 1 in a staggered fashion since swelling portions of the pockets 2 of respective PTPs are displaced from each other and engaged when filled into the packing box B. Furthermore, the medicine PTP of the present invention may be configured such that a cover plate with a shape corresponding to an opening of the PTP in the cylindrical form is integrally formed at one end of the base sheet 1 and is folded and fitted to one of the openings of the PTP when made into the cylindrical form, whereupon shape retaining strength in the cylindrical form is increased, opening of the pocket 2 by pressure is facilitated, and the medicine M is taken out from the other opening.

In each of the afore-described embodiments, the pockets 2 of the base sheet 1 have a round shape as corresponding to the solid medicines M in the form of round sugar-coated pills. However, the shape of the pockets 2 can be configured in various ways depending on the shape of medicines to be stored. For example, elongated pockets may be adopted for elongated capsules. Further, the configuration that the pockets 2 in one column are arranged on each lateral surface s (FIG. 1) in the angular cylindrical form is exemplified in the embodiments. However, the configuration that the pockets 2 in two or more columns are arranged on each lateral surface s may be adopted, for example, when medicines M are small. Furthermore, for the fold line 4 of the base sheet 1, a variety of forming means which render the fold line 4 easy to be folded and resistant to tearing such as very shallow cuts, widely spaced perforations, a habit formed by shape memory techniques can be adopted other than forming by the exemplified linear thin portions. Further, detailed configurations such as the horizontal and vertical dimension of the base sheet 1 in the flat form, the number and arrangement intervals of the pockets 2 in each column, the configuration of the attachment portion as fastening means of both side edges 1*a* and 1*b* of the base sheet 1 which are joined in the angular cylindrical form can be modified in various ways other than the embodiments in the present invention.

Figure 11:
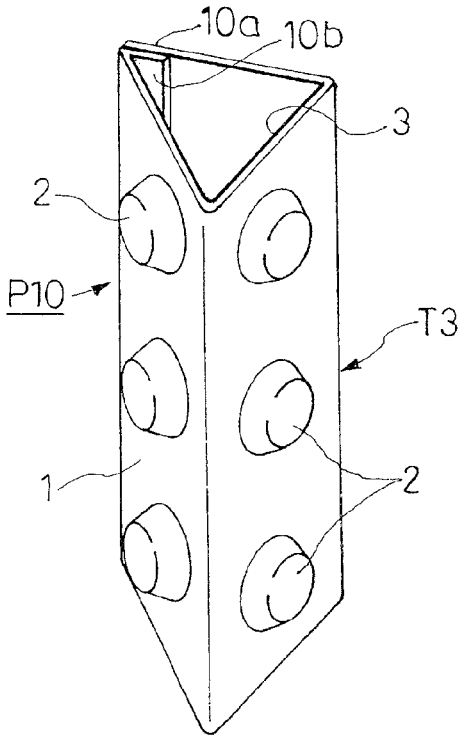
FIG. 11 is a perspective view of a PTP according to a tenth embodiment of the present invention.
Figure 12:
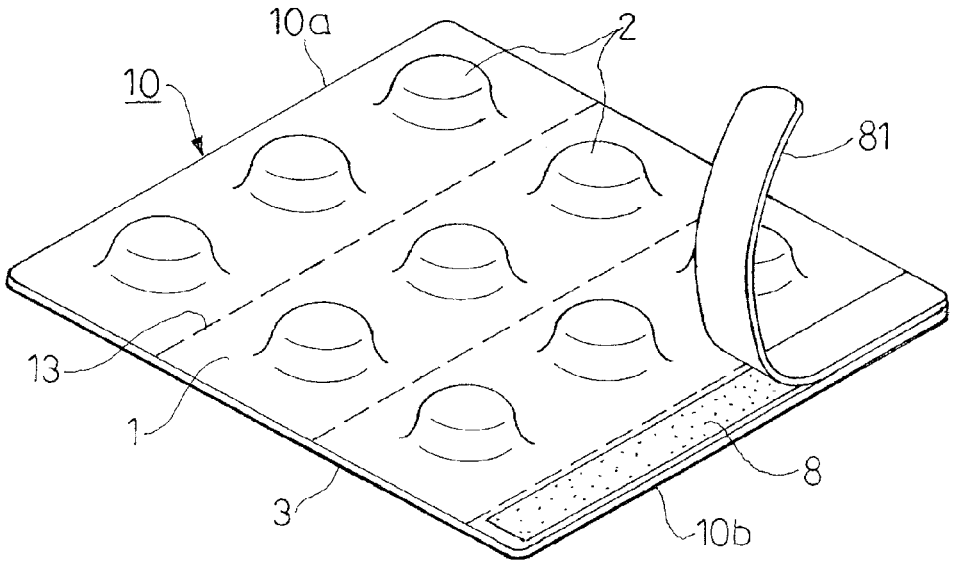
FIG. 12 is a perspective view of a PTP sheet used for the PTP.

A PTP P10 of the tenth embodiment as shown in FIG. 11 is formed by folding a PTP sheet 10 as shown in FIG. 12 at three parallel fold lines 13 into a triangular cylindrical body T3. The PTP sheet 10 includes a rectangular transparent base sheet 1 formed of thermoplastic resin such as polyvinyl chloride, polypropylene, and polyethylene terephthalate and a plurality (9 pieces in FIG. 12) of pockets 2 swelling roundly on the front surface of the base sheet 1 and arranged in a matrix. Solid medicines M1 (see FIG. 14) in the form of round sugar-coated pills are stored in respective pockets 2 one by one, and in this state, a cover film 3 formed of aluminum foil, etc., is attached to the rear surface of the base sheet 1, whereby each pocket 2 is sealed.

The PTP sheet 10 has one side edge 10*b* serving as a strip fastening piece demarcated by the fold line 13 across an entire length of the side edge 10*b*. An adhesive layer 8 with a release paper 81 is formed on the front surface of the side edge 10*b*. In assembling the PTP sheet 10 to the triangular cylindrical body T3, the PTP sheet 10 is folded at the fold lines 13, the release paper 81 is peeled off to expose the adhesive layer 8, and the exposed adhesive layer 8 is adhered and fixed to the rear surface of the other non-folded side edge 10*a*. It is noted that each fold line 13 is composed of linear thin portions or perforations so as to be folded easily but to resist tearing.

Figure 13:
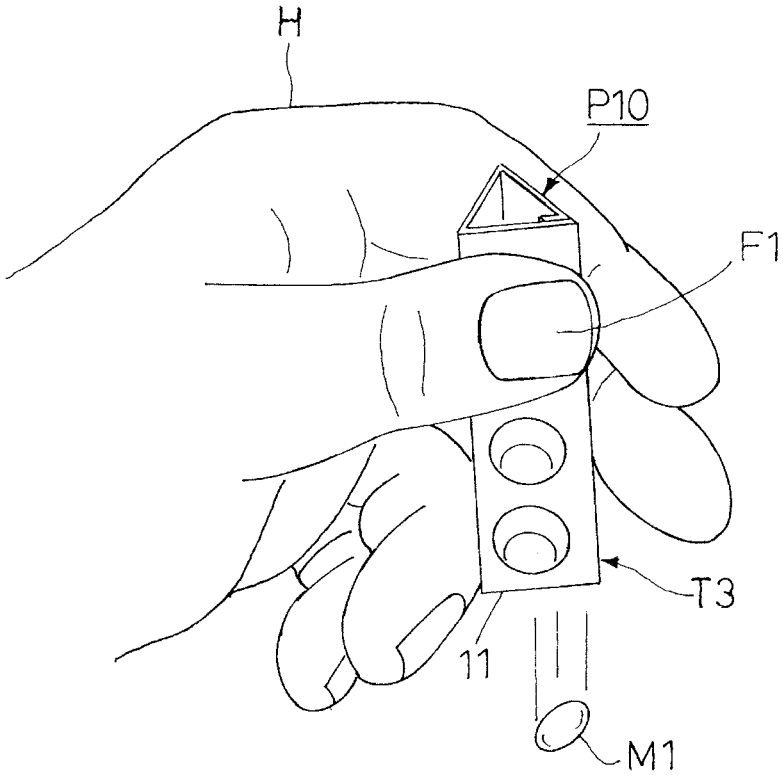
FIG. 13 is a perspective view showing an operation of taking out an article in the PTP.
Figure 14:
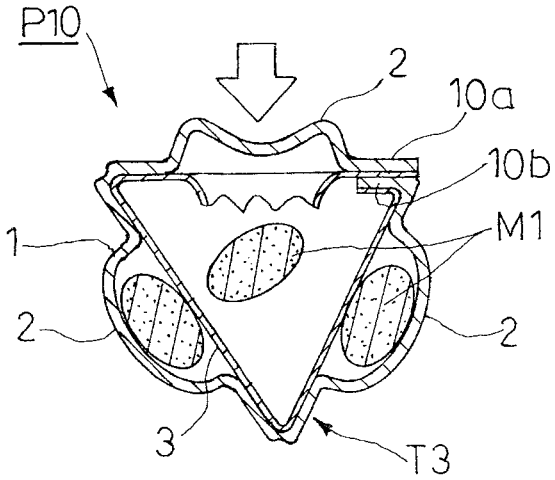
FIG. 14 is a cross sectional plan view showing an operation of opening the PTP.

Since having no cut-off lines on the base sheet 1 from the start, the PTP P10 of the triangular cylindrical body T3 cannot be separated into small units of one or two pockets by hand. In addition, to separate the PTP P10 into small units by scissors, etc., is not conceivable from its three-dimensional structure. Thus, the patient has no other choice but to press the pocket 2 from the outside and break the seal in order to remove and take the medicine M1, and there is no possibility of swallowing the whole PTP without opening it. This opening operation can be conducted simply by pressing the pocket 2 with a thumb F1 while the PTP P10 is held by one hand H as shown in FIG. 13. The medicine M1 having broken through the cover film 3 by the opening is discharged inside the triangular cylindrical body T3 as shown in FIG. 14. As a result, the medicine M1 cannot improperly pop out and be scattered around. Furthermore, the medicine M1 made to fall out from the inside of the triangular cylindrical body T3 can be reliably received by the palm of a disengaged hand. According to the PTP P10, it is possible to avoid the medicine M1 from falling on the floor, etc., and getting dirty and becoming no longer good or getting lost and requiring time and effort to find. Further, the cover film 3 of the PTP sheet 10 is generally located at an inner periphery of the triangular cylindrical body T3, and accordingly, the cover film 3 does not come into contact with fabric or another article even when PTP P10 is carried about in a clothes pocket or a bag, etc., for a long time. As a result, a tear or peel of the cover film 3 due to contact is not caused, and a completely sealed state can be maintained.

In this PTP P10, the triangular cylindrical body T3 is formed by fastening both side edges 10*a* and 10*b* of the PTP sheet 10. Thus, no additional accessories such as a holder for housing the PTP sheet 10 are required, and an increase in cost resulting from the additional accessories can be advantageously avoided. A means for fastening both side edges 10*a* and 10*b* of the PTP sheet 10 includes a variety of fastening methods such as heat seal, adhesion by a liquid glue, engagement of a slit at one side edge and an engaging piece at the other side edge, engagement of fold back portions formed on both side edges, stapling, a combination of the above, etc., other than the adhesion fixing by the adhesive layer 8 as exemplified.

Figure 15A:
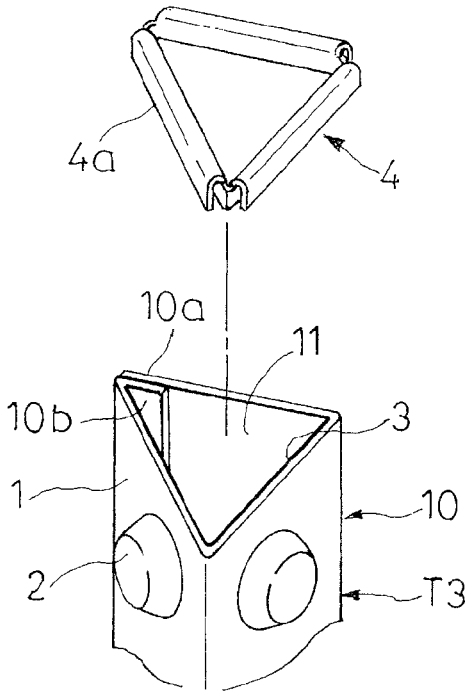
FIGS. 15A-15B show a PTP according to an eleventh embodiment of the present invention.
Figure 15B:
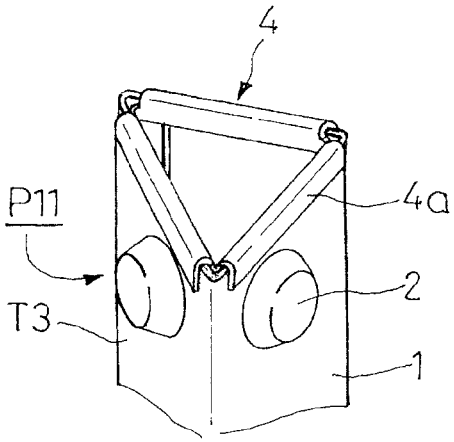

Subsequently, a PTP P11 of the eleventh embodiment as shown in FIGS. 15A-15B is described. In the PTP P11, a triangular cylindrical body T3 is formed by folding a PTP sheet 10 and fastening side edges 10*a* and 10*b* in the same manner as the afore-described tenth embodiment. The triangular cylindrical body T3 has cylinder openings 11 at both ends thereof to which triangular annular opening frame members 4 are fitted and fixed respectively. Each opening frame member 4 is formed by cutting out a rigid thermoplastic resin tube into a ring, shaping it into a triangle, providing a fin 4*a* to each side of the triangle, and folding the fins 4*a* outward. The opening frame member 4 is fitted in such a manner that the annular portion is placed inside the cylinder opening 11 of the triangular cylindrical body T3 and the fin 4*a* is placed outside the cylinder opening 11. The opening frame member 4 is then fixed by adhesion or heat seal.

As for the PTP P11 of the eleventh embodiment, not only can the same operation and effects as the PTP P10 of the tenth embodiment be achieved but also shape retaining strength as a cylindrical body is increased by the opening frame members 4 fixed to the cylinder openings 11 at both ends of the triangular cylindrical body T3. Thus, there is no concern that the cylindrical shape gets crushed at the time of opening even if the material of the PTP sheet 10 is non-elastic. There is an advantage that the opening operation can be conducted easily.

Figure 16:
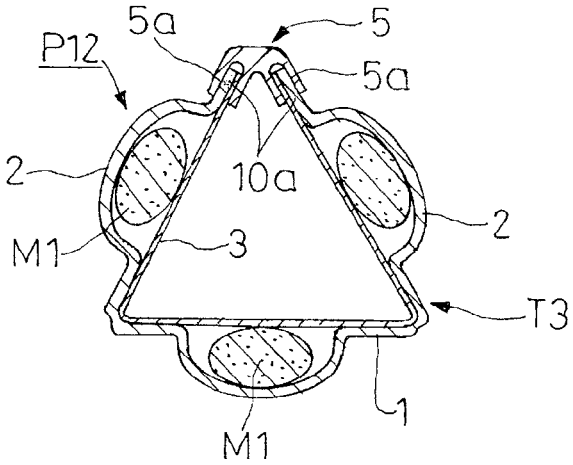
FIG. 16 is a cross sectional plan view of a PTP according to a twelfth embodiment of the present invention.

Further, in a PTP P12 of the twelfth embodiment as shown in FIG. 16, a PTP sheet 10 is folded at two lines into a triangular cylindrical shape. The PTP sheet 10 has both non-folded side edges 10*a* which are coupled and integrated via a strip edge frame 5, whereupon a triangular cylindrical body T3 is formed. The strip edge frame 5 is composed of a molded product having a length across the entire length of the triangular cylindrical body T3 and made of a rigid or semi-rigid synthetic resin. The strip edge frame 5 has both side edges in a substantially V-shape in cross section provided with grooves 5*a* opening toward side end surfaces respectively. The side edges 10*a* of the PTP sheet 10 are inserted into respective grooves 5*a* and fixed by adhesion or heat seal. In the PTP P12 of the twelfth embodiment as well, the same operation and effects as the PTP P10 of the tenth embodiment can be achieved. Additionally, there is an advantage that shape retaining strength as the cylindrical body is increased by the strip edge frame 5 and the assembling and manufacturing of the PTP P12 is facilitated.

If provided for medical purposes as in the PTPs P10 to P12 of the tenth to twelfth embodiments, the PTP may be delivered as a space-saving PTP sheet 10 as in FIG. 12 from a manufacturer side to a dispensary of a medical institution or a pharmacy, etc., and then assembled into a cylindrical form before handed to a patient according to a prescription, in addition to being formed into a final cylindrical body at the manufacturer side such as a drug manufacturer and shipped as a product. The medicine housed in the PTP is not limited to one type as in the tenth to twelfth embodiments. Different types of medicines according to columns or rows may be stored in pockets 2 arranged in a plurality of columns along a longitudinal direction of the cylindrical body or in a plurality of rows along a circumferential direction. Further, the cylindrical body is not restricted to the triangular cylindrical body T3 as in the tenth and eleventh embodiments, and may be a polygonal cylindrical body having four or more angles.

Figure 17A:
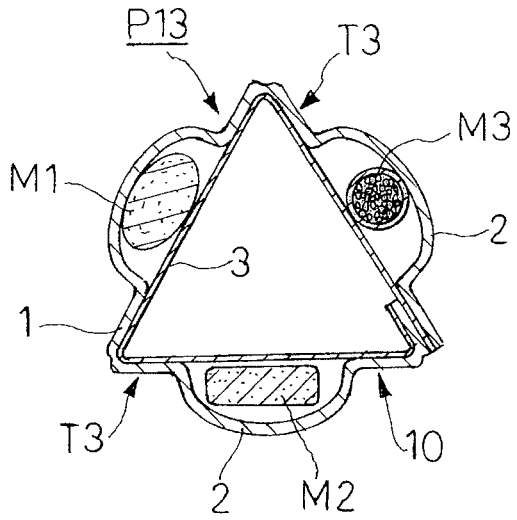
FIGS. 17A-17B show thirteenth and fourteenth embodiments of the present invention.

A PTP P13 of the thirteenth embodiment as shown in FIG. 17A includes a triangular cylindrical body T3 provided with pockets 2 storing three types of medicines different among the sides, for example, medicines M1 in the form of sugar-coated pills, medicines M2 in the form of tablets, and medicines M3 in the form of granule-containing capsules. A PTP P14 of the fourteenth embodiment as shown in FIG. 17B includes a square cylindrical body T4 provided with pockets 2 storing four types of medicines different among the sides, for example, the above three types of medicines M1 to M3 and also medicines M4 in the form of sugar-coated small pills.

It is very convenient in those PTPs P13 and P14 that the number of pockets 2 on each side, for example, that is, the number of pockets 2 disposed in the column direction is set to be three and that medicines per day are housed altogether in such a manner that the plurality of types of medicines M1 to M3 or M1 to M4 to be taken in a single dose by a patient are sorted and stored in each of upper, middle, and lower rows, and each of the different types of medicines arranged in the upper row, the middle row, or the lower row are taken in the morning, the daytime, or the evening, respectively. It is a matter of course that the number of the pockets 2 in the column direction is set to be six and medicines for two days may be housed. For medicines taken twice a day, the pockets 2 in the column direction is set to be even-numbered and medicines for one to several days may be housed. Further, contrary to the exemplified, the plurality of types of medicines can be stored in pockets 2 on each side, that is, in each column direction, and the medicines on one side, that is, in one column can be provided for a single dose.

Figure 17B:
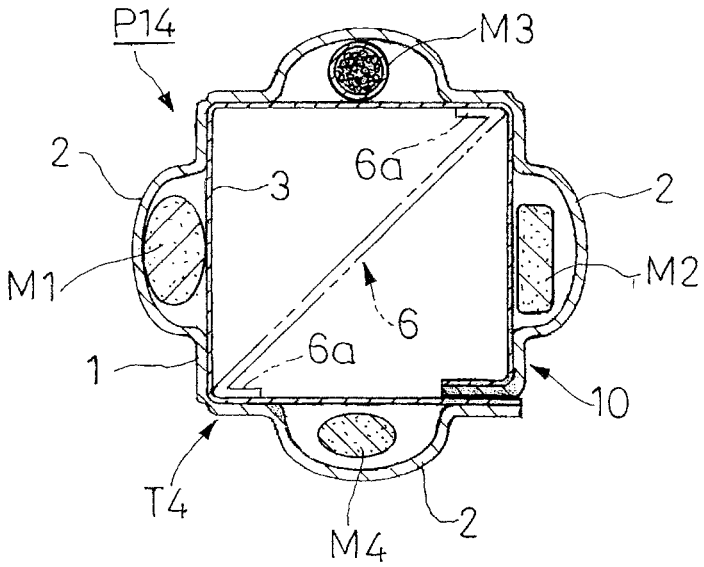

In a case where the cylindrical body comprises a polygonal cylindrical body having four or more angles, a reinforcing plate 6 is arranged inside the polygonal cylindrical body so as to extend along a diagonal direction as shown by virtual line in FIG. 17B, for example, and both lateral portions 6*a* of the reinforcing plate 6 are fastened on an inner surface of the cylindrical body. When thus configured, shape retaining strength as the cylindrical body is increased accordingly. Thus, the opening operation can be advantageously conducted easily and reliably. Further, a plurality of reinforcing plates 6 may be used when the cylindrical body is of a polygon more than a pentagon.

Figure 18A:
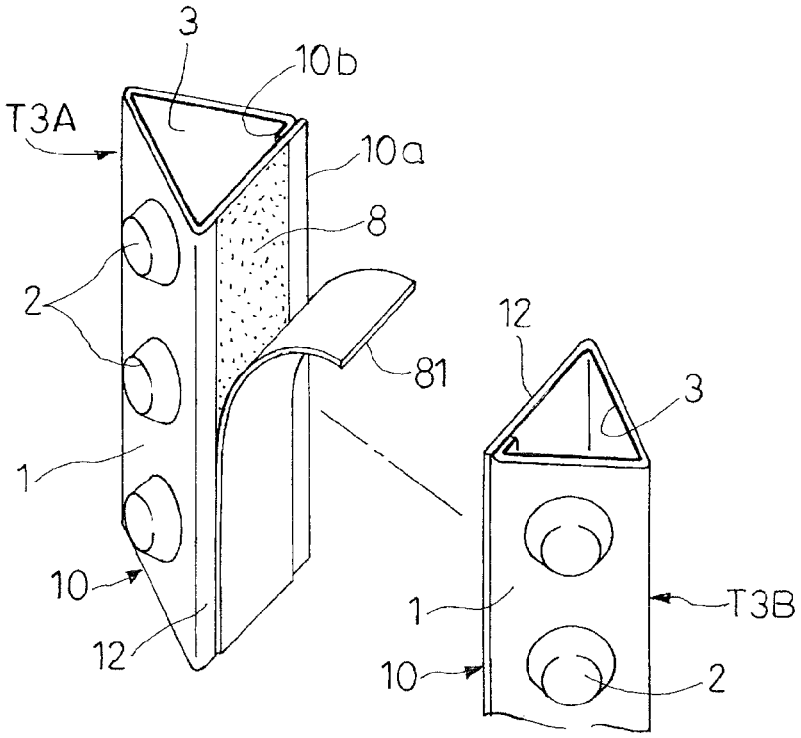
FIGS. 18A-18B show a PTP according to a fifteenth embodiment of the present invention.
Figure 18B:
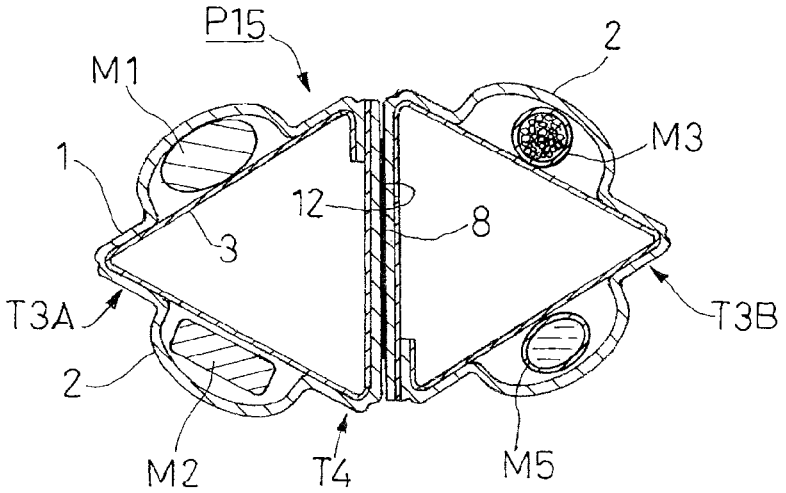

Additionally, a combination of a plurality of types of medicines to be taken in a single dose by a patient sometimes varies depending on the degree of symptom or differences between individuals, etc., even in the same case of a disease. However, the PTP of the present invention is easily adaptable to variations of the combination. For example, a PTP P15 of the fifteenth embodiment as shown in FIGS. 18A-18B includes a square cylindrical body T4 combined by two triangular cylindrical bodies T3A and T3B, each formed by folding a PTP sheet 10. Medicines M1 in the form of sugar-coated pills and medicines M2 in the form of tablets are stored in pockets 2 on two sides of one of the triangular cylindrical bodies T3A, respectively, and medicines M3 in the form of granule-containing capsules and medicines M5 in the form of liquid-containing capsules are stored in pockets 2 on two sides of the other triangular cylindrical body T3B, respectively, wherewith four types of medicines come into combination. In this instance, the rest of the sides of each triangular cylindrical body T3A or T3B constitutes a flat surface 12 without pockets 2. The flat surface 12 of one of the triangular cylindrical bodies T3A is formed with an adhesive layer 8 with a release paper 81. The adhesive layer 8 whose release paper 81 is peeled off is adhered to the flat surface 12 of the other triangular cylindrical body T3B, thereby joining and integrating both triangular cylindrical bodies T3A and T3B.

In a PTP P16 of the sixteenth embodiment as shown in FIG. 19, two triangular cylindrical bodies T3C and T3D are united in the same manner as the fifteenth embodiment and constitute a square cylindrical body T4. Two sides of each triangular cylindrical body T3C or T3D which are provided with pockets 2 are composed of a PTP sheet 10. A flat surface 12 on one side without pockets 2 is formed by another plate body 7 of rigid synthetic resin having been fastened to folded side edges 10*b* of the PTP sheet 10. Both triangular cylindrical bodies T3C and T3D are joined and integrated via an adhesive layer 8 provided on one of the flat surfaces 12 in the same manner as the fifteenth embodiment. Mutually different types of medicines (not shown) are stored in the pockets 2 of both triangular cylindrical bodies T3C and T3D.

According to the configuration that two cylindrical bodies in which different types of medicines are stored are combined and integrated as in the fifteenth and sixteenth embodiments, a variety of cylindrical bodies different according to the type of medicine are prepared, thereby allowing for various combinations of medicines suitable for the degree of symptom of a patient or differences between individuals, etc. A means for joining the cylindrical bodies to each other includes a variety of methods such as adhesion by a liquid glue or heat seal, or more simply, stapling or binding by an adhesive tape other than joining by the adhesive layer 8 as exemplified.

Furthermore, the present invention can suit a greater number of combinations of medicines by configuring the two sides of the angular cylindrical body to be flat surfaces without pockets and joining and integrating the flat surfaces with each other. For example, a PTP P17 of the seventeenth embodiment as shown in FIG. 20A includes a square cylindrical body T4 formed by joining and integrating four triangular cylindrical bodies T3 each having pockets 2 only on one side, and thus the PTP P17 is suited to a combination of four types of medicines in total. A PTP P18 of the eighteenth embodiment as shown in FIG. 20B includes a hexagonal cylindrical body T6 formed by joining and integrating six triangular cylindrical bodies T3 each having pockets 2 only on one side and suited to a combination of six types of medicines. Further, a PTP P19 of the nineteenth embodiment as shown in FIG. 20C includes a square cylindrical body T4 formed by joining and integrating four square cylindrical bodies T4 each provided with pockets 2 on two sides and suited to a combination of eight types of medicines. Other special forms include a PTP P20 of the twentieth embodiment as shown in FIG. 20D in which three hexagonal cylindrical bodies T6 provided with pockets 2 on four sides are joined and integrated and a PTP P21 of the twenty-first embodiment as shown in FIG. 20E in which three pentagonal cylindrical bodies T5 provided with pockets 2 on three sides are joined and integrated. The former is suited to a combination of 12 types of medicines, and the latter, 9 types.

Figure 21:
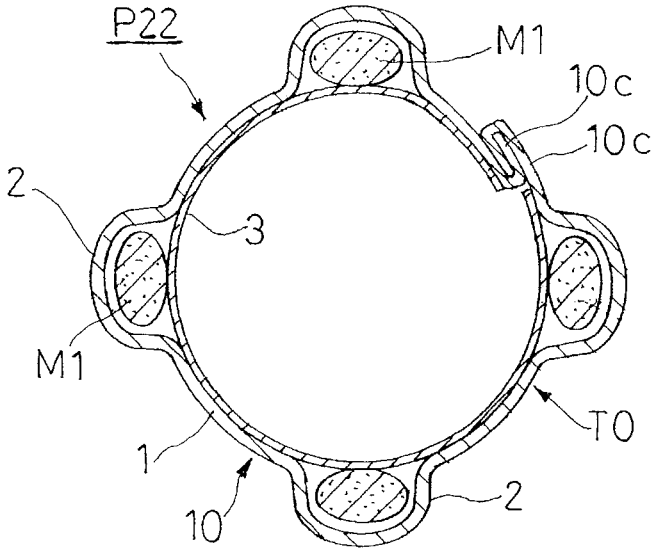
FIG. 21 is a cross sectional plan view of a PTP of a twenty-second embodiment of the present invention.

Any of the afore-described PTPs P10 to P21 of the tenth to twenty-first embodiments comprises an angular cylindrical body having three to six angles T3 to T6 or a combination of a plurality thereof. However, the PTP of the present invention may comprise a circular cylindrical body TO as in a PTP P22 of the twenty-second embodiment as shown in FIG. 21, for example, or an elliptical cylindrical body (not shown). In the PTP P22 of the twenty-second embodiment as exemplified, both side edges 10*c* of a PTP sheet 10 having been folded inward and outward are engaged with each other and formed into the circular cylindrical body TO. A means for fastening both side edges of the PTP sheet 10 in order to form the circular cylindrical body T0 includes a variety of methods, similar to the afore-described angular cylindrical body.

The articles to be stored in the PTP of the present invention are not restricted to solid medicines as exemplified in the tenth to twenty-second embodiments, and include troches, throat lozenges, solid health food equivalent to drugs such as a variety of supplements, chocolate chips, chocolate balls, toffees, candies, chewing gum, cookies, biscuits, granular confectioneries such as nuts, solidified soup stocks, curry roux, crystal sugar, granulated sugar, food like solidified seasonings, solid bath agents, solid detergents, and chemical agents, etc., such as pipe cleaning agents. Furthermore, small screws, nails, nuts, washers, rubber packings, and various small articles for crafts, etc., such as handicraft beads can be stored in the PTP. Particularly, for a tiny article, a plurality of pieces may be stored in one pocket 2. Granular, powder, or liquid articles, etc., as well as solid articles can be stored if necessary.

Figure 22:
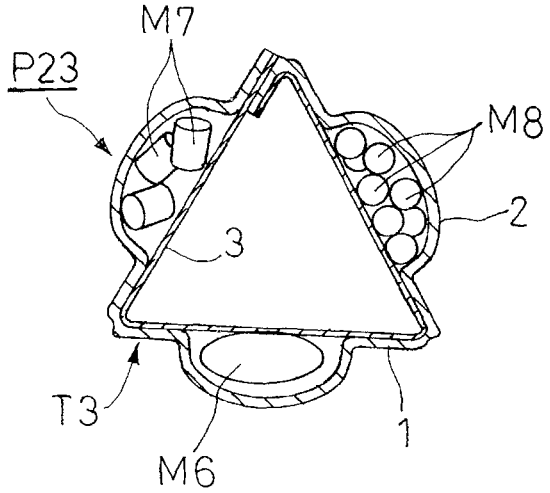
FIG. 22 is a cross sectional plan view of a PTP according to a twenty-third embodiment of the present invention.
Figure 23:
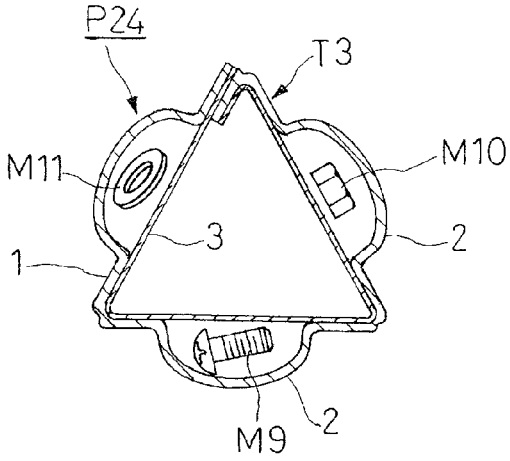
FIG. 23 is a cross sectional plan view of a PTP according to a twenty-fourth embodiment of the present invention.

For example, a PTP P23 of the twenty-third embodiment as shown in FIG. 22 stores candies M6, chocolate chips M7, and small grain sugar M8 respectively on each side of a triangular cylindrical body T3, and a combination of three types of confectioneries can be enjoyed. Further, a PTP P24 of the twenty-fourth embodiment as shown in FIG. 23 stores a set of a small screw M9, a nut M10, and a washer M11 in three pockets 2 arranged in the circumferential direction of the triangular cylindrical body T3, separated. Thus, parts necessary at one spot can conveniently be taken out at one time without being scattered at the time of screw clamping.

Figure 24A:
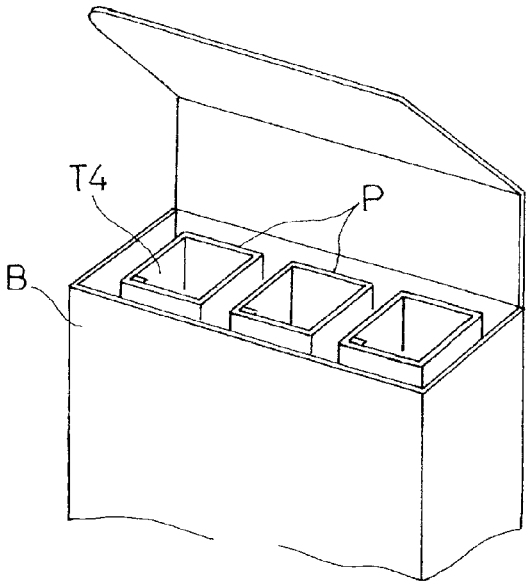
FIGS. 24A-24B show a packing box in an opened state which houses products of PTPs for articles such as medicines according to the present invention.
Figure 24B:
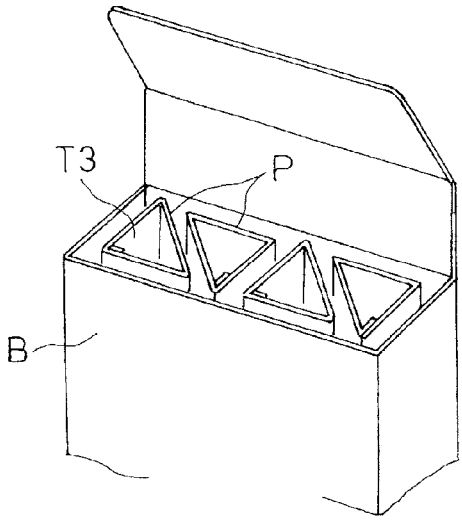

In addition, as for the PTP assembled into the cylindrical body in advance at the manufacturer side and put on the market, it is recommended that a plurality of PTPs formed into the square cylindrical bodies T4 or triangular cylindrical bodies T3 are filled into a packing box B and brought into a product as exemplified in FIGS. 24A-24B, for example. In this instance, the triangular cylindrical body T3 is preferably in a cylindrical shape of an isosceles right triangle as shown rather than an equilateral triangle so that a plurality of the PTPs can be stored in a rectangular space easily. Further, if the PTP filled in the packing box B is configured such that the pockets 2 of the base sheet 1 are arranged in a staggered fashion, mutual swelling portions of the pockets 2 are displaced and engaged when the PTPs are filled into the packing box B. Therefore, space efficiency is increased and the number of the PTPs to be filled can be increased.

What is claimed is:

1. A medicine press-through package comprising:

a base sheet having two opposed side edges;

a plurality of finger-pressable pockets swelling on a front surface of the base sheet and storing solid medicines one by one;

a breakable cover film attached to a rear surface of the base sheet and sealing the pockets;

the pockets being inseparably joined in the package;

the base sheet having a plurality of three to six tear resistant fold lines parallel with the side edges;

the base sheet and cover film being folded on the fold lines to form a hollow, internally unsupported, tubular package of angular cylindrical form having three to six angles and with the finger-pressable pockets swelling outside;

means to fasten the side edges of the base sheet together, said fastening means comprising a plurality of protrusions protruding from one side edge of the base sheet and a plurality of corresponding slits in an opposed side edge of the base sheet;

the side edges of the base sheet being fastened together by the fastening means; and each pocket, when pressed from the outside, being operable to discharge a solid medicine through the cover film and into the inside of the angular cylindrical form and out of an opening at one end of the angular cylindrical form.

2. A press-through package comprising:

a base sheet having two opposed side edges;

a plurality of inseparably joined, finger-pressable pockets swelling on a front surface of the base sheet and storing articles one by one;

a breakable cover film attached to a rear surface of the base sheet and sealing the pockets;

a press-through package sheet being constituted by the base sheet, the plurality of pockets, and the breakable cover film;

a plurality of tear-resistant fold lines formed in the base sheet parallel to the side edges, the base sheet and cover film having been formed into an angular, hollow cylindrical body with the pockets swelling on an outer periphery thereof by bending of the press-through package sheet on the tear-resistant fold lines and both side edges being fastened together by a fastening means comprising a plurality of protrusions protruding from one side edge of the base sheet and a plurality of corresponding slits in an opposed side edge of the base sheet, and each pocket in the angular cylindrical body, when pressed from the outside, being operable to discharge an article through the cover film and into the inside the angular cylindrical body and out of an opening at one end of the angular cylindrical body.

3. The press-through package according to claim 2, wherein the pockets are arranged in a plurality of columns along a longitudinal direction of the cylindrical body or in a plurality of rows along a circumferential direction of the cylindrical body, and different kinds of articles according to the columns or the rows are stored in the pockets.

4. The press-through package according to claim 2, wherein the articles are solid medicines or solid food.

5. The medicine press-through package according to claim 1, wherein the base sheet and cover film are folded on the fold lines to form a tubular package of triangular cylindrical form having three angles.

6. The press-through package according to claim 1, wherein the base sheet and cover film are folded on the fold lines to form a tubular package of triangular cylindrical form having three angles.

* * * * *